US011037488B1

(12) United States Patent
Wang et al.

(10) Patent No.: US 11,037,488 B1
(45) Date of Patent: Jun. 15, 2021

(54) PIXEL DRIVER CIRCUIT, DISPLAY PANEL, DISPLAY DEVICE, AND DRIVING METHOD

(71) Applicant: Xiamen Tianma Micro-Electronics Co., Ltd., Xiamen (CN)

(72) Inventors: Ting Wang, Xiamen (CN); Hongbo Zhou, Xiamen (CN); Huangyao Wu, Xiamen (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 16/916,718

(22) Filed: Jun. 30, 2020

(30) Foreign Application Priority Data

Apr. 24, 2020 (CN) ..... 202010334607.9

(51) Int. Cl.
*G09G 3/32* (2016.01)

(52) U.S. Cl.
CPC ..... *G09G 3/32* (2013.01); *G09G 2310/0267* (2013.01); *G09G 2310/0275* (2013.01); *G09G 2320/0666* (2013.01)

(58) Field of Classification Search
CPC ..... G09G 3/32; G09G 2310/0267; G09G 2310/0275; G09G 2320/0666
See application file for complete search history.

(56) References Cited

U.S. PATENT DOCUMENTS 6,897,618 B2 * 5/2005 Fukuzako ..... G09G 3/3216 315/169.1
7,187,355 B2 * 3/2007 Tam ..... G09G 3/3258 345/76
7,557,778 B2 * 7/2009 Le Roy ..... G09G 3/3258 345/76
9,159,262 B2 * 10/2015 Kikuchi ..... G09G 3/3233
10,002,565 B2 * 6/2018 Kikuchi ..... G09G 3/3266
2002/0047817 A1 * 4/2002 Tam ..... G09G 3/3258 345/76
2003/0142048 A1 * 7/2003 Nishitani ..... G09G 3/3258 345/82
2007/0152934 A1 * 7/2007 Maeda ..... G09G 3/3233 345/92

(Continued)

FOREIGN PATENT DOCUMENTS

CN 105308863 A 2/2016
CN 108335674 A 7/2018

*Primary Examiner* — Dmitriy Bolotin
(74) *Attorney, Agent, or Firm* — von Briesen & Roper, s.c.

(57) ABSTRACT

Disclosed are a pixel driver circuit, a display panel, a display device, and a driving method. The pixel driver circuit includes a data write module, a storage module, a first potential adjustment module, a second potential adjustment module, a comparison module, and a light emission control module. The data write module is configured to write a data signal into a first node at a first stage. The first potential adjustment module and the second potential adjustment module are configured to adjust a potential of a second node at a second stage and at a third stage, causing the comparison module to output a first control signal and a second control signal to the light emission control module at the second stage and at the third stage, respectively. The light emission control module is configured to control the light emission control module to be turned off and turned on according to the first control signal and the second control signal, respectively.

20 Claims, 9 Drawing Sheets

(56) References Cited

U.S. PATENT DOCUMENTS

| | | | | |
|---|---|---|---|---|
| 2007/0222718 | A1* | 9/2007 | Takahara | G09G 3/2011 345/76 |
| 2014/0292745 | A1* | 10/2014 | Kikuchi | G09G 3/32 345/213 |
| 2016/0118971 | A1* | 4/2016 | Sugiyama | H03K 5/2481 345/691 |

* cited by examiner

PIXEL DRIVER CIRCUIT, DISPLAY PANEL, DISPLAY DEVICE, AND DRIVING METHOD

CROSS-REFERENCE TO RELATED APPLICATIONS

This application claims the priority and benefit of China patent application No. 202010334607.9 filed on Apr. 24, 2020, the disclosure of which is hereby incorporated herein by reference in its entirety.

TECHNICAL HELD

Embodiments of the present disclosure relate to the field of display technologies and, in particular, to a pixel driver circuit, a display panel, a display device, and a driving method.

BACKGROUND

A current-driven display panel, such as an organic light emitting diode (OLED) display panel and a light emitting diode (LED) display panel, has many advantages, such as being all-solid-state, having wide viewing angle, having fast response and the like, and has great application prospects in the display field.

Each pixel unit of the current-driven display panel includes a pixel driver circuit and a light emitting element. The light emitting element is a current-driven piece, and the pixel driver circuit provides a driving current to the light emitting element. That is, the pixel driver circuit controls the luminance of the light emitting element by controlling the magnitude of the driving current. However, when different driving currents are used to drive light emitting elements of the same color, the luminous chromaticity of different light emitting elements may be different, thereby affecting the display effect of the display panel. For example, according to the image display requirements, the luminance of a red light emitting element A is LA, the luminance of a red light emitting element B is LB, where LA is not equal to LB. Then, if different driving currents are provided to the red light emitting element A and the red light emitting element B, the luminous chromaticity of the red light emitting element A and the luminous chromaticity of the red light emitting element B will be different from each other.

SUMMARY

The present disclosure provides a pixel driver circuit, a display panel, a display device, and a driving method to solve the problem that the display chromaticity of light emitting elements of the same color is different under different display brightness.

In a first aspect, an embodiment of the present disclosure provides a pixel driver circuit. The pixel driver circuit includes a data write module, a storage module, a first potential adjustment module, a second potential adjustment module, a comparison module, and a light emission control module.

The data write module is electrically connected to the first potential adjustment module at a first node. The storage module is electrically connected between the first node and a first level signal end. The first potential adjustment module is electrically connected between the first level signal end and a second node. The first potential adjustment module is electrically connected to the second potential adjustment module at the second node. The second potential adjustment module includes a potential pulse signal end, and the second node is electrically connected to a first input end of the comparison module. A second input end of the comparison module is in control of a reference signal. An output end of the comparison module is electrically connected to a control end of the light emission control module.

The data write module is configured to write a data signal into the first node at a first stage. The first potential adjustment module and the second potential adjustment module are configured to adjust a potential of the second node at a second stage, causing the comparison module to output a first control signal to the control end of the light emission control module based on the potential of the second node and the reference signal. The light emission control module is configured to control an output end of the light emission control module to be turned off according to the first control signal.

The first potential adjustment module and the second potential adjustment module are configured to adjust the potential of the second node at a third stage, causing the comparison module to output a second control signal to the control end of the light emission control module based on the potential of the second node and the reference signal. The light emission control module is configured to output a driving signal through the output end of the light emission control module according to the second control signal.

In a second aspect, an embodiment of the present disclosure further provides a driving method for a display panel, the display panel including a plurality of the pixel driver circuits described in the first aspect, and the driving method including the following operations.

In S1, at a first stage, a data write module writes a data signal into the first node.

In S2, at a second stage, the first potential adjustment module and the second potential adjustment module are configured to adjust the potential of the second node, causing the comparison module to output a first control signal to the control end of the light emission control module based on the potential of the second node and the reference signal, where the light emission control module is controlled by the first control signal, and the output end of the light emission control module is turned off.

In S3, at a third stage, the first potential adjustment module and the second potential adjustment module are configured to adjust the potential of the second node, causing the comparison module to output a second control signal to the control end of the light emission control module based on the potential of the second node and the reference signal, where the light emission control module is controlled by the second control signal, and the output end of the light emission control module outputs a driving signal.

In a third aspect, an embodiment of the present disclosure further provides a display panel including a plurality of pixel units arranged in a matrix, where each of the plurality of pixel units includes a light emitting element and a pixel driver circuit described in the first aspect.

An output end of a light emission control module of the pixel driver circuit is electrically connected to an anode of the light emitting element.

In a fourth aspect, an embodiment of the present disclosure further provides a display device including the display panel described in the third aspect.

In the pixel driver circuit, the display panel, the display device, and the driving method provided by the embodiments of the present disclosure, the data write module, the storage module, the first potential adjustment module, the second potential adjustment module, the comparison module, and the light emission control module are disposed in the pixel driver circuit, where the data write module is electrically connected to the first potential adjustment module at the first node; the storage module is electrically connected between the first node and the first level signal end; the first potential adjustment module is electrically connected between the first level signal end and the second node; the first potential adjustment module is electrically connected to the second potential adjustment module at the second node; the second potential adjustment module includes the potential pulse signal end, and the second node is electrically connected to the first input end of the comparison module; the second input end of the comparison module is in control of the reference signal; the output end of the comparison module is electrically connected to the control end of the light emission control module; the data write module is configured to write the data signal into the first node at the first stage; the first potential adjustment module and the second potential adjustment module are configured to adjust the potential of the second node at the second stage, causing the comparison module to output the first control signal to the control end of the light emission control module based on the potential of the second node and the reference signal; the light emission control module is configured to control the output end of the light emission control module to be turned off according to the first control signal; and the first potential adjustment module and the second potential adjustment module are configured to adjust the potential of the second node at the third stage, causing the comparison module to output the second control signal to the control end of the light emission control module based on the potential of the second node and the reference signal; and the light emission control module is configured to output the driving signal through the output end of the light emission control module according to the second control signal, thereby achieving the drive control of the light emitting element. Since the longer the duty ratio of a light emitting duration of the light emitting element in one driving cycle (including the first stage, the second stage, and the third stage) of the pixel driver circuit, the greater the luminance displayed by the light emitting element, on the basis of providing a fixed driving current to each light emitting element, a pulse width modulation method may be used. That is, the duty ratio of the light emitting duration of the light emitting element is adjusted in one driving cycle (including the first stage, the second stage and the third stage) of a pixel driver circuit, so that the light emitting elements display different luminance. The duty ratio of the light emitting duration refers to a ratio of the light emitting duration of the light emitting element to the driving cycle of the pixel driver circuit in one driving cycle of the pixel driver circuit. Embodiments of the present disclosure solve the problem of deviation of both the chromaticity and the luminous efficiency of each light emitting element when the existing pixel driver circuit is driving, achieve regulation and control of the luminance of each light emitting element, and ensure consistency of luminous chromaticity and luminous efficiency of each light emitting element, thereby improving the display effect of the entire display panel.

DETAILED DESCRIPTION

Figure 1:
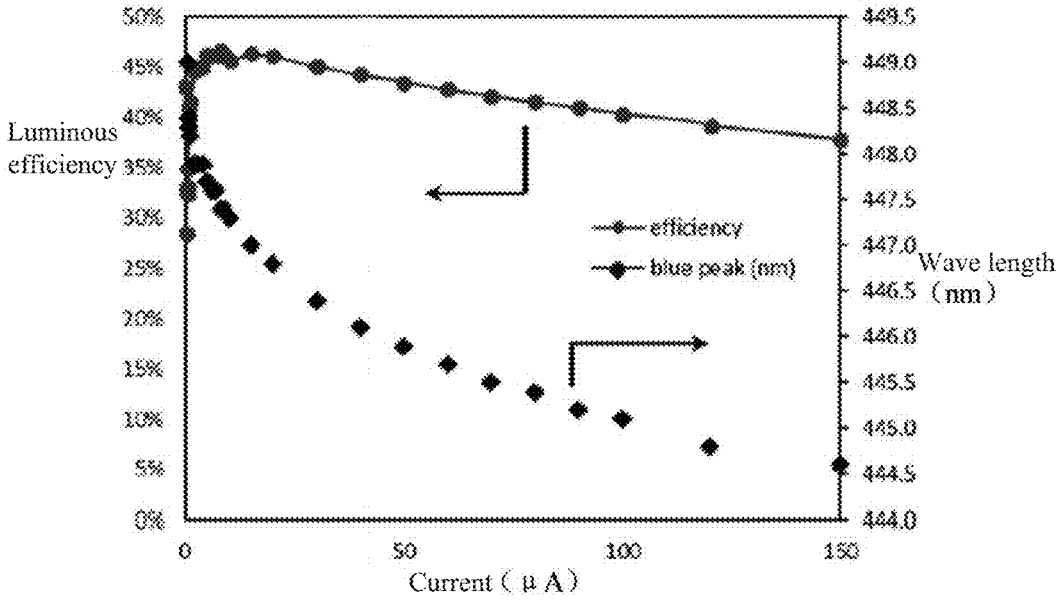
FIG. 1 is a current drive characteristic curve of an existing current-driven Micro-LED light emitting element.

Hereinafter the present disclosure will be further described in detail in connection with the drawings and embodiments. It is to be understood that the specific embodiments set forth herein are merely intended to illustrate rather than limit the present disclosure. Additionally, for ease of description, merely part, instead of all, of the structures related to the present disclosure are illustrated in the drawings.

Figure 2:
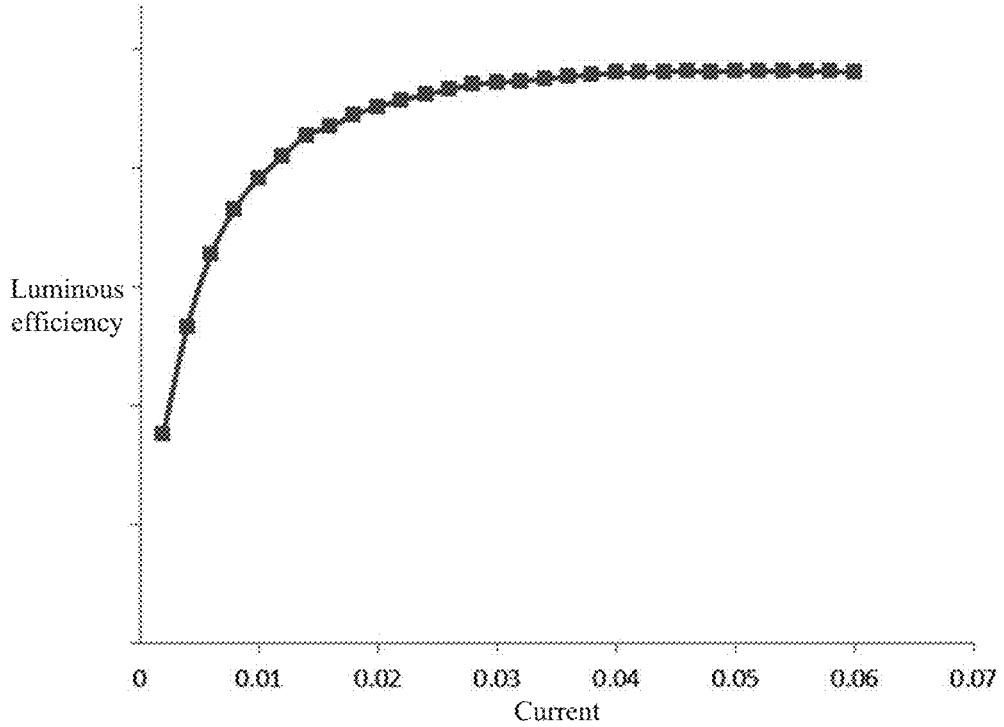
FIG. 2 is a graph illustrating the luminous efficiency of an existing current-driven light emitting element.

As described in the previous Background section, in the existing current-driven display panel, a light emitting element has a fixed light emitting duration, a driving current is supplied to the light emitting element through a pixel driver circuit, and luminance of the light emitting element is controlled by the driving current. FIG. 1 is a current drive characteristic curve of an existing current-driven Micro-LED light emitting element. Referring to FIG. 1, a luminous wavelength of the current-driven Micro-LED light emitting element decreases with the increase of the driving current, where the luminous wavelength represents luminous chromaticity of the light emitting element. In other words, for two Micro-LED light emitting elements of the same color, when different luminance is achieved by different driving currents, the luminous chromaticity may deviate due to different driving currents. Finally, the luminous chromaticity of the light emitting elements of the same color in the display panel is different under different luminance, resulting in uneven display chromaticity, thus affecting the display effect. FIG. 2 is a graph illustrating the luminous efficiency of an existing current-driven light emitting element. Referring to FIG. 2, it may be known that the luminous efficiency of the current-driven light emitting element is related to the driving current, and when the driving current is small, the luminous efficiency of the light emitting element is low and varies greatly, which easily leads to instability of the luminous efficiency.

From the above, it may be known that the existing current-driven light emitting element has certain chromaticity deviation when driven with different driving currents due to its own luminous characteristics, and the luminous efficiency of the light emitting element is also affected by the driving currents. In view of the above problem, an embodiment of the present disclosure provides a pixel driver circuit.

Figure 3:
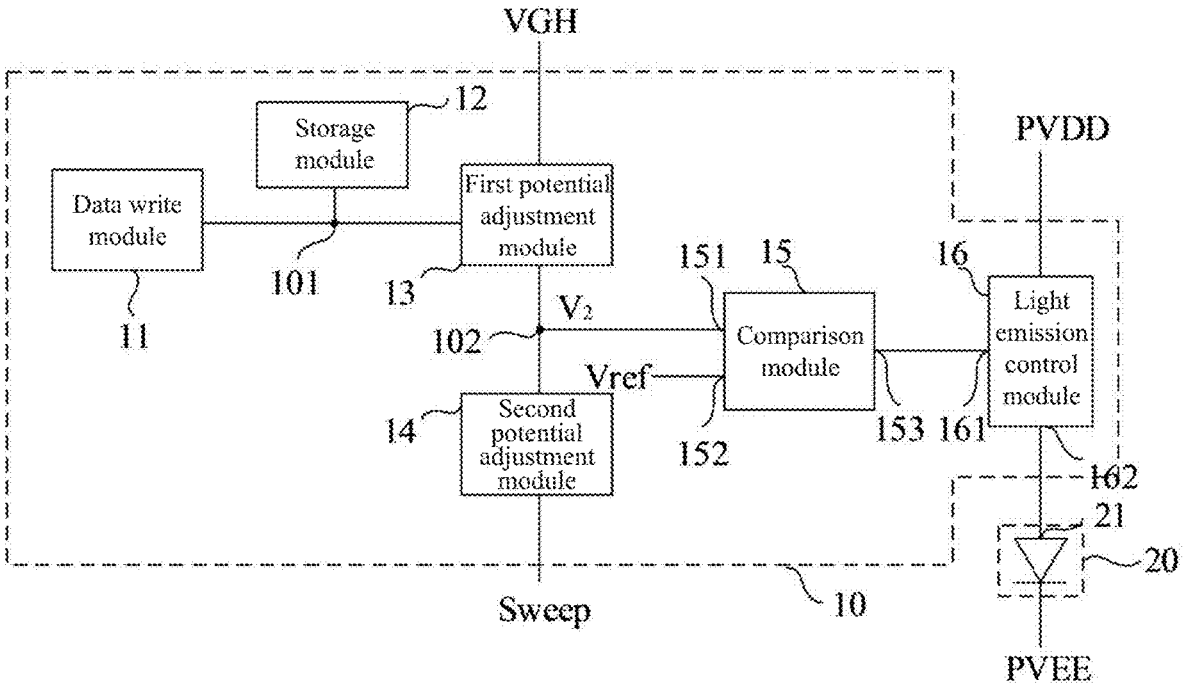
FIG. 3 is a block diagram of a pixel driver circuit according to an embodiment of the present disclosure.

FIG. 3 is a block diagram of a pixel driver circuit according to an embodiment of the present disclosure, Referring to FIG. 3, the pixel driver circuit includes a data write module 11, a storage module 12, a first potential adjustment module 13, a second potential adjustment module 14, a comparison module 15, and a light emission control module 16. The data write module 11 is electrically connected to the first potential adjustment module 13 at a first node 101. The storage module 12 is electrically connected between the first node 101 and a first level signal end VGH. The first potential adjustment module 13 is electrically connected between the first level signal end VGH and a second node 102. The first potential adjustment module 13 is electrically connected to the second potential adjustment module 14 at the second node 102. The second potential adjustment module 14 farther includes a potential pulse signal end Sweep, and the second node 102 is electrically connected to a first input end 151 of the comparison module 15. A second input end 152 of the comparison module 15 is controlled by a reference signal. An output end 153 of the comparison module 15 is electrically connected to a control end 161 of the light emission control module 16.

The data write module 11 is configured to write a data signal into the first node 101 at a first stage. The first potential adjustment module 13 and the second potential adjustment module 14 are configured to adjust a potential of the second node 102 at a second stage, such that the comparison module 15 outputs a first control signal to the control end 161 of the light emission control module according to the potential of the second node 102 and the reference signal. The light emission control module 16 is configured to control an output end 162 of the light emission control module 16 to be turned off according to the first control signal. Additionally, the first potential adjustment module 13 and the second potential adjustment module 14 are configured to adjust the potential of the second node 102 at a third stage, such that the comparison module 15 outputs a second control signal to the control end 161 of the light emission control module 16 according to the potential of the second node 102 and the reference signal; and the light emission control module 16 is configured to output a driving signal through the output end 162 of the light emission control module 16 according to the second control signal.

The pixel driver circuit 10 shown in FIG. 3 is correspondingly used to drive a light emitting element 20, and the light emitting element 20 may be of a current-driven type, in which case the pixel driver circuit 10 outputs a driving current to the light emitting element 20 to drive the light emitting element 20 to emit light according to preset luminance. The light emission control module 16 in the pixel driver circuit 10 is used to control an on-off of a circuit where the light emitting element 20 is located by controlling an introduction of the driving current on the light emitting element 20, so as to control the light emitting element 20 to emit light. The comparison module 15 outputs a signal for controlling the on-off to the light emission control module 16 according to a comparison result of a signal of the first input end 151 and a signal of the second input end 152. The reference signal is input to the second input end 152 of the comparison module 15, and the first input end 151 is electrically connected to the second node 102. Two comparison signals provided by the first input end 151 and the second input end 152 of the comparison module 15 are derived from the potential of the second node 102 and a potential of the reference signal. In this way, according to the known reference signal, different control signals can be output from the comparison module 15 by reasonably controlling the potential of the second node 102 to control the on-off of the light emission control module 16, thereby achieving a light emitting control of the light emitting element 20. It could be understood that, in a case where power supply signals supplied to each of the light emitting elements 20 are guaranteed to be the same, a current when a circuit where the light emitting element 20 is turned on is the same, that is, driving currents supplied by each of the pixel driver circuits 10 to corresponding light emitting elements 20 is consistent, such that the luminous chromaticity and the luminous efficiency of each of the light emitting elements 20 can be guaranteed to be consistent. However, in order to control light emitting elements 20 at different positions to achieve different luminance such that the display panel achieves different display pictures, the duty ratio of the light emitting duration of the light emitting element 20 may be adjusted. The longer the duty ratio of the light emitting duration of the light emitting element in one driving cycle (including the first stage, the second stage, and the third stage) of the pixel driver circuit, the greater the luminance.

As described above, by utilizing the potential of the second node 102, the on-off of the light emission control module 16 may be controlled, thereby controlling the light emitting duration of the light emitting element 20.

The potential of the second node 102 may be adjusted by the first potential adjustment module 13 and the second potential adjustment module 14, As can be seen from the circuit between the first level signal end VGH and the potential pulse signal end Sweep, the potential of the second node 102 will have a potential $V_2$, where $V_2=V_{sweep}+(V_{GH}-V_{sweep})/(R_2+R_3)*R_3$, and $R_2$ and $R_3$ are resistances of the first potential adjustment module 13 and the second potential adjustment module 14, respectively. In this way, in the circuit between the first level signal end VGH and the potential pulse signal end Sweep, the potential $V_2$ of the second node 102 is substantially dependent on a resistance ratio of the first potential adjustment module 13 and the second potential adjustment module 14. By reasonably controlling and adjusting resistances of the first potential adjustment module 13 and the second potential adjustment module 14, adjustment and control of the potential of the second node 102 may be achieved.

The first potential adjustment module 13, the storage module 12 and the data write module 11 are connected to the first node 101, where the data write module 11 is used for writing the data signal to the first node 101, and the storage module 12 is used for storing the data signal written by the data write module 11, so as to adjust the resistance of the first potential adjustment module 13 in a suitable time period. On the condition that the variation trend of the resistance of the second potential adjustment module 14 is known or the variation trend of the resistance of the second potential adjustment module 14 is controlled, the data signal can be used to achieve regulation and control of the second node 102, and further, the control of the light emitting duration of the light emitting element 20 can be achieved by the comparison module 15 and the light emission control module 16. Therefore, in the pixel driver circuit provided by the embodiment of the present disclosure, a pulse width modulation method may be used in a case where the driving current is fixed during the light emission duration of light emitting element 20 to adjust the duty ratio of the light emitting duration of a corresponding light emitting element 20 through the data signal, That is, the duty ratio of the light emitting duration of the light emitting element is adjusted in one driving cycle (including the first stage, the second stage and the third stage) of a pixel driver circuit, such that the light emitting element displays different luminance.

It is to be noted that in the embodiment of the present disclosure, in order to facilitate illustration of a structure and signal of the pixel driver circuit and simply the description, part of signal ends and signals on the part of signal ends are represented by the same symbol. As illustrated in FIG. 3, the first level signal end of the first potential adjustment module 13 and a level signal thereof are represented by VGH, and the potential pulse signal end of the second potential adjustment module 14 and the potential adjustment pulse signal thereof are represented by Sweep, Additionally, the light emission control module 16 and the light emitting element 20 are substantially connected to a first power supply signal end and a second power supply signal end, and therefore both the first power supply signal end and a first power supply signal thereof are represented by PVDD, and both the second power supply signal end and a second power supply signal thereof are represented by PVEE.

Figure 4:
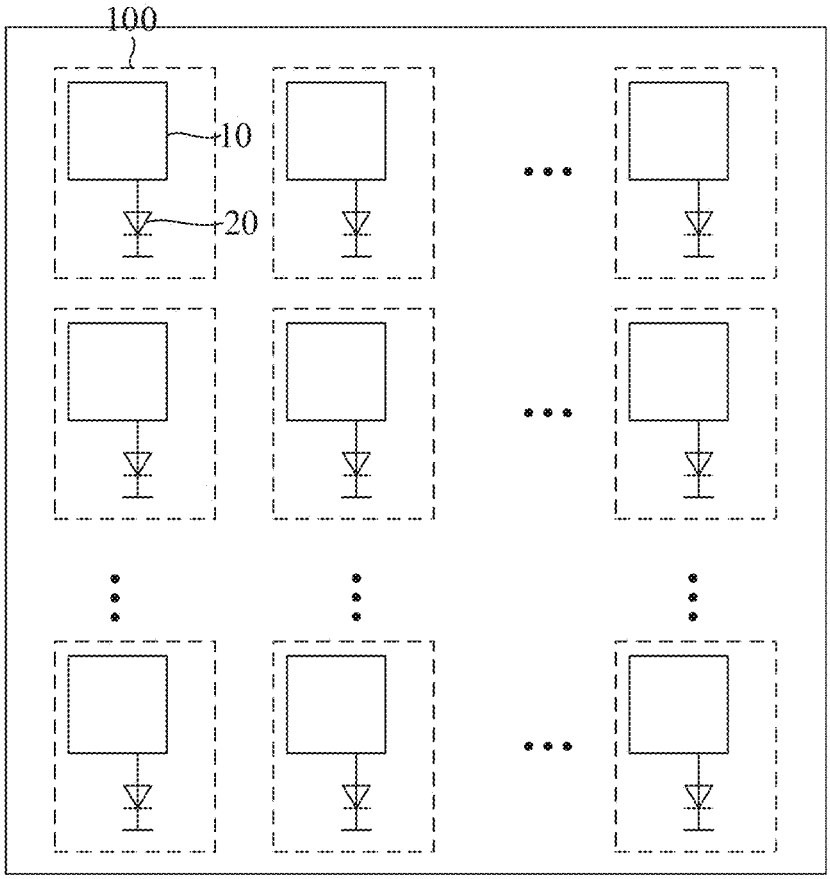
FIG. 4 is a schematic diagram of a display panel according to an embodiment of the present disclosure.

Based on the above-described pixel driver circuit, an embodiment of the present disclosure further provides a display panel. FIG. 4 is a structural diagram of a display panel according to an embodiment of the present disclosure. Referring to FIG. 3 and FIG. 4, the display panel includes a plurality of pixel units 100 arranged in a matrix, where each of the plurality of pixel units 100 includes a light emitting element 20 and any one of the pixel driver circuits 10 provided by the embodiment of the present disclosure, and the output end 162 of the light emission control module 16 of the pixel driver circuit 10 is electrically connected to an anode 21 of the light emitting element 20. The pixel driver circuit 10 is used for supplying the driving signal to the light emitting element 20 through the light emission control module 16 to control the light emitting element 20 to emit light, such that each pixel unit 100 in the display panel is displayed to form a display picture.

Figure 5:
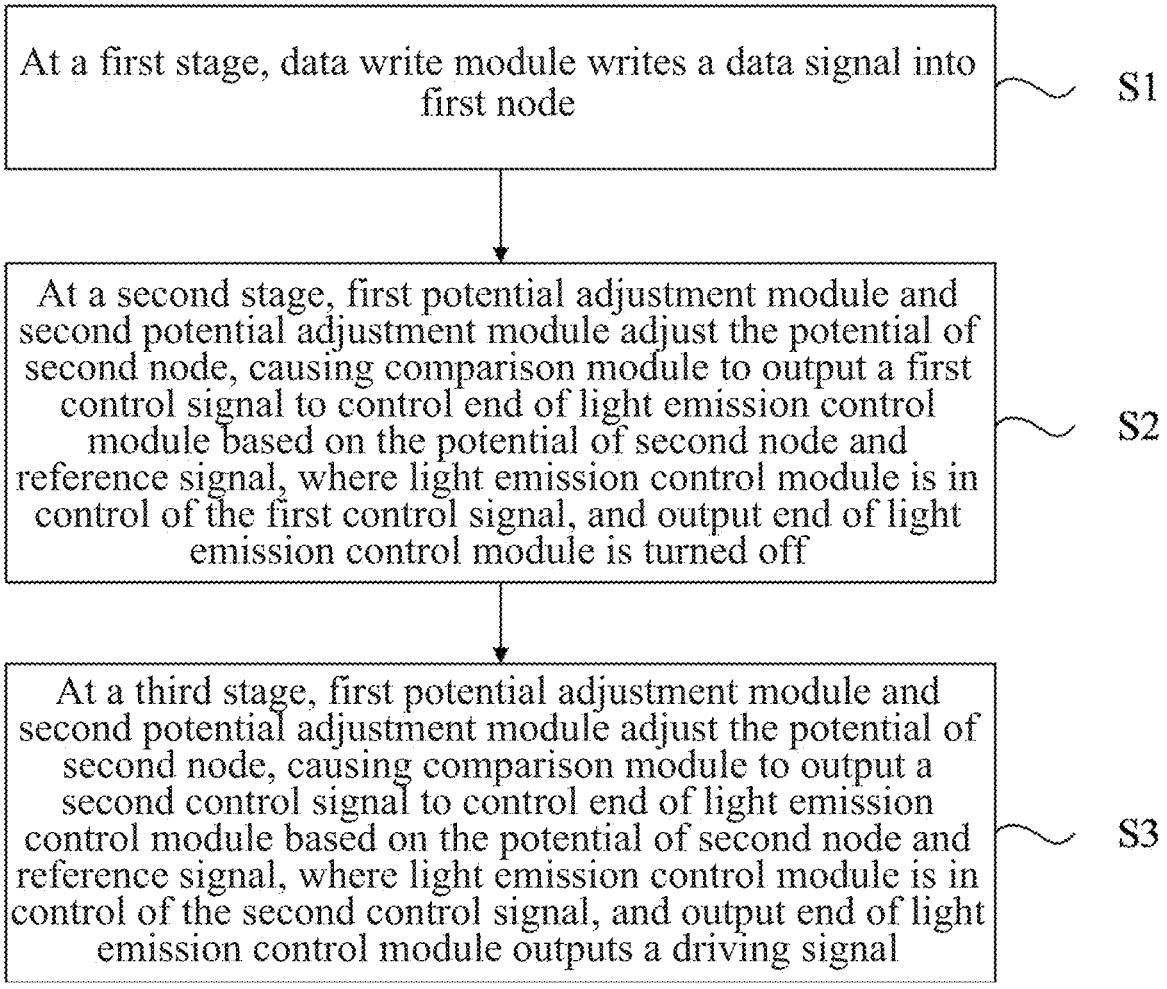
FIG. 5 is a flowchart of a driving method for a display panel according to an embodiment of the present disclosure.

It could be understood that, in the above-mentioned display panel, the pixel units 100 are arranged in the matrix, and therefore the pixel driver circuits 10 in the pixel units 100 are arranged in a plurality of rows and columns. The working process and principle of the pixel driver circuit and the display panel provided by the embodiments of the present disclosure will be described below. FIG. 5 is a flowchart of a driving method for a display panel according to an embodiment of the present disclosure. Referring to FIG. 3 to FIG. 5, the driving method includes the steps described below.

In S1, at the first stage, the data write module writes the data signal into the first node.

This stage is essentially a data writing stage, and the pixel driver circuit 10 stores the data signal.

In S2, at the second stage, the first potential adjustment module and the second potential adjustment module are configured to adjust the potential of the second node, causing the comparison module to output the first control signal to the control end of the light emission control module based on the potential of the second node and the reference signal, where the light emission control module is controlled by the first control signal, and the output end of the light emission control module is turned off.

In this stage, in the case where the potential pulse signal end. Sweep of the second potential adjustment module 14 is known, the resistance of the second potential adjustment module 14 can be determined. At the same time, on the basis that the first level signal end VGH of the first potential adjustment module 13 is known, the resistance of the first potential adjustment module 13 may be adjusted through the data signal stored in the first node 101, thereby achieving adjustment of the potential of the second node 102. Adjusted potential of the second node 102 is input to the first input end 151 of the comparison module 15, and the comparison module 15 outputs a signal. That is, the first control signal compares the potential of the second node of the first input end 151 with the reference signal of the second input end 152 to control the light emission control module 16 to turn off. At this time, the circuit where the light emitting element 20 is located is turned off, and the light emitting element 20 remains in an off state.

In S3, at the third stage, the first potential adjustment module and the second potential adjustment module are configured- to adjust the potential of the second node, causing the comparison module to output the second control signal to the control end of the light emission control module based on the potential of the second node and the reference signal, where the light emission control module is controlled by the second control signal, and the output end of the light emission control module outputs the driving signal.

Similarly, in this stage, on the basis that signals of the first level signal end VGH of the first potential adjustment module 13 and the potential pulse signal end Sweep of the second potential adjustment module 14 are known, the potential of the second node 102 can be regulated and controlled by utilizing the data signal stored in the first node 101, such that the signal at the first input end 151 of the comparison module 15 changes, and then the comparison module 15 outputs the second control signal for controlling the light emission control module 16 to turn on and output the driving signal in this stage. It is to be noted that, in order to ensure that the output of the comparison module 15 at the third stage varies from the output of the comparison module 15 at the second stage, the potential $V_2$ of the second node needs to be reasonably adjusted such that the potential $V_2$ of the second node changes from being greater than the reference signal Vref of the comparison module 15 at the second stage to being smaller than the reference signal of the comparison module 15, or changes from being smaller than the reference signal Vref of the comparison module 15 at the second stage to being greater than the reference signal Vref of the comparison module 15.

From the above driving process of the pixel driver circuit and the display panel, it can be seen that, at the third stage, the light emitting element 20 emits light by the driving signal supplied by the pixel driver circuit 10, and a time length of the third stage determines the light emitting duration of the light emitting element 20, that is, determines the luminance of the light emitting element 20. Therefore, on the basis of the signals input by the first level signal end VGH and the potential pulse signal end Sweep in each pixel driver circuit, by reasonably setting the data signal input and stored by the first node 101, each light emitting element 20 can be controlled to emit light, and the luminance of each light emitting element 20 can be regulated and controlled, thereby achieving the image display of the entire display panel.

In the pixel driver circuit provided by the embodiments of the present disclosure, the data write module, the storage module, the first potential adjustment module, the second potential adjustment module, the comparison module and the light emission control module are disposed. The data write module is electrically connected to the first potential adjustment module at the first node. The storage module is electrically connected between the first node and the first level signal end. The first potential adjustment module is electrically connected between the first level signal end and the second node. The first potential adjustment module is electrically connected to the second potential adjustment module at the second node. The second potential adjustment module includes the potential pulse signal end, and the second node is electrically connected to the first input end of the comparison module. The second input end of the comparison module is controlled by the reference signal. The output end of the comparison module is electrically connected to the control end of the light emission control module. The data write module is configured to write the data signal into the first node at the first stage. The first potential adjustment module and the second potential adjustment module are configured to adjust the potential of the second node at the second stage, causing the comparison module to output the first control signal to the control end of the light emission control module based on the potential of the second node and the reference signal. The light emission control module is configured to control the output end of the light emission control module to be turned off according to the first control signal; and the first potential adjustment module and the second potential adjustment module are configured to adjust the potential of the second node at the third stage, causing the comparison module to output the second control signal to the control end of the light emission control module based on the potential of the second node and the reference signal. The light emission control module is configured to output the driving signal through the output end of the light emission control module according to the second control signal. In this way, a drive control of the light emitting element is achieved, and, on the basis of providing the fixed driving current to each light emitting element, the pulse width modulation method may be used, that is, the duty ratio of the light emitting duration of the light emitting element is adjusted in one driving cycle (including the first stage, the second stage and the third stage) of a pixel driver circuit, such that the light emitting elements display different luminance. The embodiments of the present disclosure solve the problem that both the chromaticity and the luminous efficiency may deviate when the existing pixel driver circuit is driving, achieve regulation and control of the luminance of each light emitting element, and ensure consistency of the luminous chromaticity and the luminous efficiency of each light emitting element, thereby improving the display effect of the entire display panel.

Figure 6:
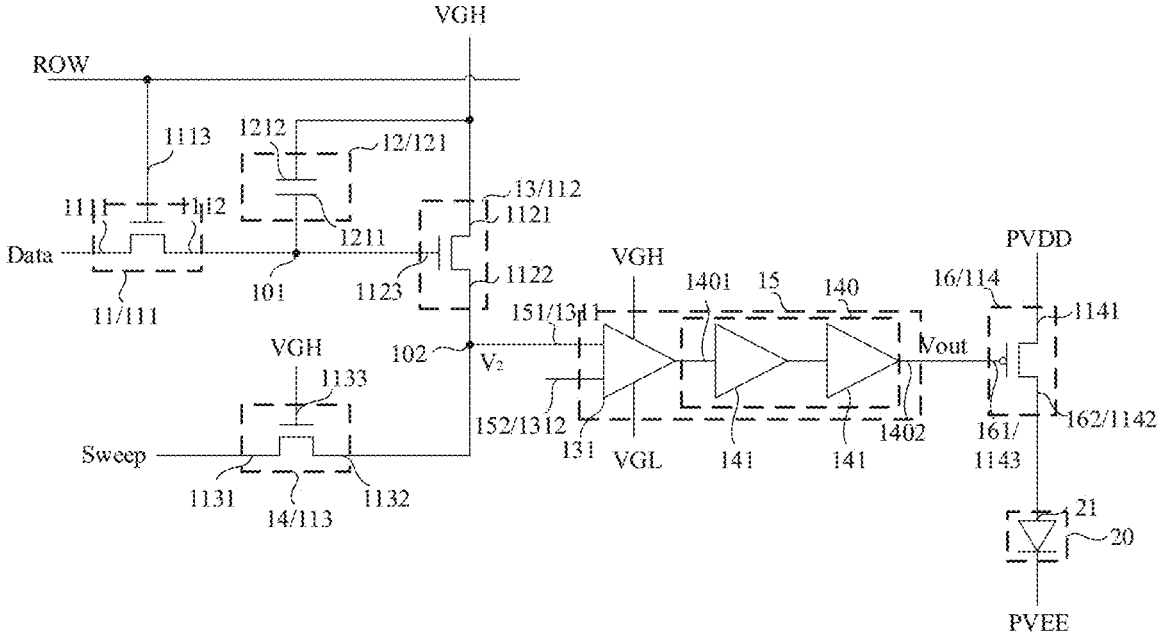
FIG. 6 is a schematic diagram of another pixel driver circuit according to an embodiment of the present disclosure.

An embodiment of the present disclosure provides a specific pixel driver circuit for each circuit module of the pixel driver circuit provided by the above-mentioned embodiment. FIG. 6 is a schematic diagram of another pixel driver circuit according to an embodiment of the present disclosure. Referring to FIG. 6, in the pixel driver circuit, the data write module 11 includes a first transistor 111; the storage module 12 includes a first capacitor 121; the first potential adjustment module 13 includes a second transistor 12; a first electrode 1111 of the first transistor 111 is used for acquiring the data signal; a second electrode 1112 of the first transistor 111 is electrically connected to the first node 101; a gate 1113 of the first transistor 111 is controlled by a scan signal; a first plate 1211 of the first capacitor 121 is electrically connected to the first node 101; a second plate 1212 of the first capacitor 121 is electrically connected to the first level signal end VGH; a gate 1123 of the second transistor 112 is electrically connected to the first node 101; a first electrode 1121 of the second transistor 112 is electrically connected to the first level signal end VGH; and a second electrode 1122 of the second transistor 112 is electrically connected to the second node 102.

The first transistor 111 is turned on and off by the scan signal of the gate 1113, thereby inputting the data signal of the first electrode 1111 to the first node 101 when turned on. Since the first node 101 is electrically connected to the first plate 1211 of the first capacitor 121, the process of writing the data signal into the first node 101 is essentially a process of storing charges in the first capacitor 121, that is, the first capacitor 121 achieves storage of the data signal. The second transistor 112, that is, the first potential adjustment module 13, is used to adjust the resistance of the second transistor 112 according to the control of the driving signal, thereby adjusting the potential of the second node 102. From a transistor resistance formula $$R_{on} = \frac{1}{\mu_n C_{ox} \frac{W}{L}(V_{GS} - V_{TH})},$$

it can De seen that a resistance value of the second transistor 112 mainly depends on a gate-source voltage value VGS, which is a voltage value of a source. That is, the first electrode 1121 of the second transistor 112 depends on the level signal of the first level signal end VGH, and a voltage value of the gate 1123 of the second transistor 112 depends on the potential of the first node 101, that is, the data signal stored in the first capacitor 121. In this way, the resistance value of the first potential adjustment module 13 may be adjusted by the data signal held by the first node 101.

Still referring to FIG. 6, the second potential adjustment module 14 may be configured to include a third transistor 113, where a gate 1133 of the third transistor 113 is electrically connected to the first level signal end VGH, a first electrode 1131 of the third transistor 113 is used for acquiring a potential adjustment pulse signal Sweep, and a second electrode 1132 of the third transistor 113 is electrically connected to the second node 102.

Similarly, the third transistor 113, that is, the second potential adjustment module 14, is also used to adjust its own resistance according to the control of the driving signal, and thereby to adjust the potential of the second node 102. From the transistor resistance formula $$R_{on} = \frac{1}{\mu_n C_{ox} \frac{W}{L}(V_{GS} - V_{TH})},$$

it can De seen that the resistance value of the third transistor 113 mainly depends on the gate-source voltage value, that is, the level signal of the first level signal end VGH and the potential adjustment pulse signal Sweep received by the first electrode 1131 form the gate-source voltage of the third transistor 113. The resistance value of the second potential adjustment module 14 can be adjusted by reasonably setting the level signal of the first level signal end VGH and the potential adjustment pulse signal Sweep received by the first electrode 1131.

Still referring to FIG. 6, the comparison module 15 in the pixel driver circuit may optionally include a comparator 131, where a positive phase input end 1311 of the comparator 131 is the first input end 151 of the comparison module 15; an inverting input end 1312 of the comparator 131 is the second input end 152 of the comparison module 15; a first power supply end 1313 of the comparator 131 is electrically connected to the first level signal end VGH, and a second power supply end 1314 of the comparator 131 is electrically connected to a second level signal end VGL.

The first power supply end 1313 and the second power supply end 1314 supply power to the comparator 131 according to electrical signals supplied by the first level signal end VGH and the second level signal end VGL. An output of the comparator 131 can be controlled by inputting different signals to the positive phase input end 1311 and the inverting input end 1312 of the comparator 131. Generally, an output level of the comparator 131 will jump when a magnitude relationship between the two input signals changes, and a rising edge or falling edge of an output waveform is easily delayed during the jump, resulting in an arc-shaped waveform.

Based on this, still referring to FIG. 6, in the pixel driver circuit provided by the embodiment of the present disclosure, optionally, the comparison module 15 further includes an inverter unit 140; an output end 1315 of the comparator 131 is electrically connected to an input end 1401 of the inverter unit 140; an output end 1402 of the inverter unit 140 is the output end 153 of the comparison module 15; and the inverter unit 140 includes at least one inverter 141 connected in sequence. At this time, at least one inverter 141 connected in sequence can adjust the waveform output by the comparator 131 such that the output waveform is more neat, thereby more accurately controlling the on-off of the light emission control module and ensuring light emission of the light emitting element and accurate control of the light emitting duration. As illustrated in FIG. 6, two inverters 141 may be disposed in the inverter unit 140, and at this time, an output signal level state of the comparison module 15 coincides with an output signal level state of the comparator 131.

Still referring to FIG. 6, optionally, the light emission control module 16 includes a fourth transistor 114, where a gate 1143 of the fourth transistor 114 is the control end 161 of the light emission control module 16, a first electrode 1141 of the fourth transistor 114 is electrically connected to a first power supply signal end PVDD, and a second electrode 1142 of the fourth transistor 114 is the output end 162 of the light emission control module 16.

The fourth transistor 114 may be selected as an N-type transistor or a P-type transistor, and the level signal output from the comparison module 15 can control the on-off of the fourth transistor 114, that is, the light emission control module 16. As illustrated in FIG. 6, the fourth transistor 114 is described as a P-type transistor as an example. At the second stage of the driving process of the pixel driver circuit, the first control signal output by the comparison module 15 is substantially a high level signal, and at this time, the fourth transistor 114 is turned off and the light emitting element 20 remains in the off state. At the third stage of the driving process of the pixel driver circuit, the second control signal output by the comparison module 15 is substantially a low level signal, and at this time, the fourth transistor 114 is turned on and the light emitting element 20 emits light. The fourth transistor 114 and the light emitting element 20 are connected between the first power supply signal end PVDD and the second power supply signal end PVEE, the first power supply signal PVDD and the second power supply signal PVEE supply power to the light emitting element 20, and the fourth transistor 114 is substantially responsible for the on-off of the circuit. Thus, driving currents of light emitting elements 20 corresponding to each pixel driver circuit of the display panel are consistent, so that the luminous chromaticity and the luminous efficiency of each light emitting element 20 may be kept the same.

In the pixel driver circuit illustrated in FIG. 6, the first transistor 111, the second transistor 112, and the third transistor 113 are N-type transistors, and the fourth transistor 114 is the P-type transistor, for example. In other embodiments of the present disclosure, the first transistor 111, the second transistor 112, and the third transistor 113 may further be set as the P-type transistors, and the fourth transistor 114 may be the N-type transistor. Furthermore, types of the first transistor 111, the second transistor 112, the third transistor 113, and the fourth transistor 114 may be the same or different, which will not be limited herein.

Specifically, as illustrated in FIG. 6, in the pixel driver circuit, the data write module 11 includes the first transistor 111; the storage module 12 includes the first capacitor 121; the first potential adjustment module 13 includes the second transistor 12; the first electrode 1111 of the first transistor 111 is used for acquiring the data signal; the second electrode 1112 of the first transistor 111 is electrically connected to the first node 101; the gate 1113 of the first transistor 111 is controlled by the scan signal; the first plate 1211 of the first capacitor 121 is electrically connected to the first node 101; the second plate 1212 of the first capacitor 121 is electrically connected to the first level signal end VGH; the gate 1123 of the second transistor 112 is electrically connected to the first node 101; the first electrode 1121 of the second transistor 112 is electrically connected to the first level signal end VGH; and the second electrode 1122 of the second transistor 112 is electrically connected to the second node 102. The second potential adjustment module 14 includes the third transistor 113, where the gate 1133 of the third transistor 113 is electrically connected to the first level signal end VGH, the first electrode 1131 of the third transistor 113 is used for acquiring the potential adjustment pulse signal Sweep, and the second electrode 1132 of the third transistor 113 is electrically connected to the second node 102. Based on this, an embodiment of the present disclosure further provides a driving method for a display panel. The driving method for the display panel will be described below with an example that the first transistor, the second transistor and the third transistor are N-type transistors and the fourth transistor is the P-type transistor.

Figure 7:
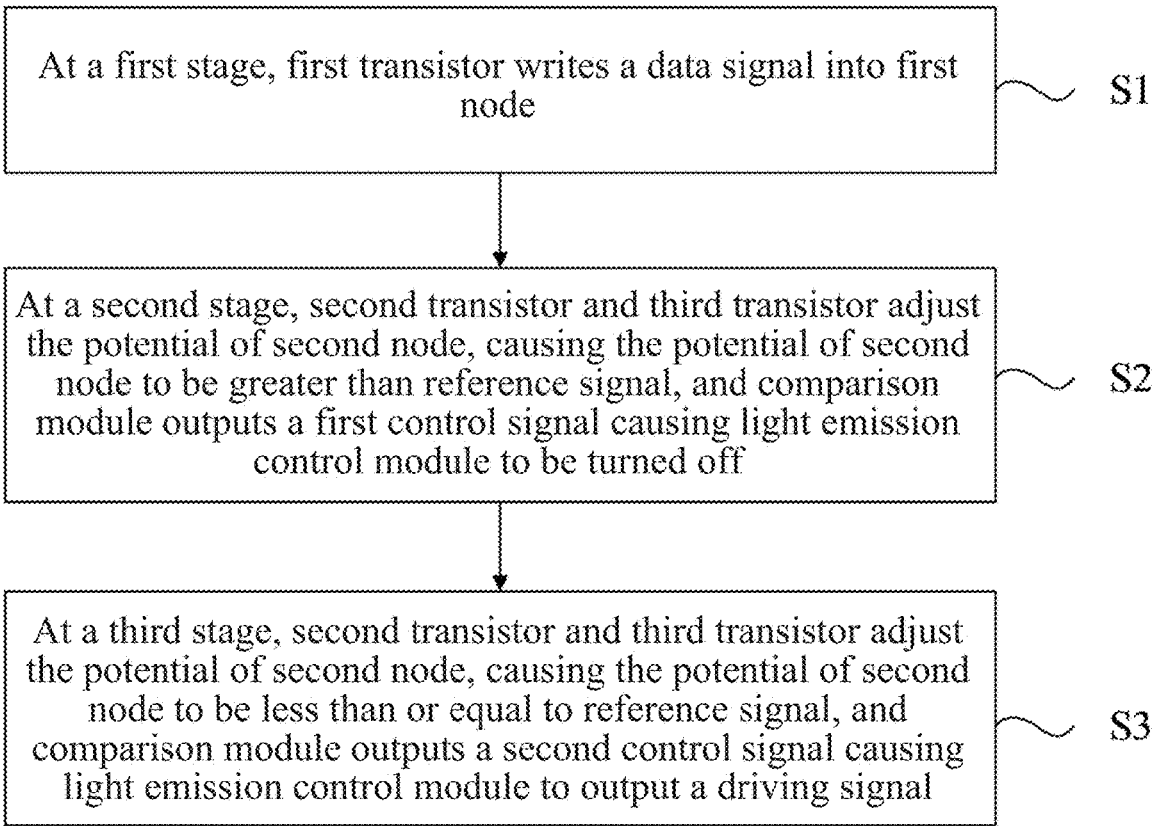
FIG. 7 is a flowchart of another driving method for a display panel according to an embodiment of the present disclosure.
Figure 8:
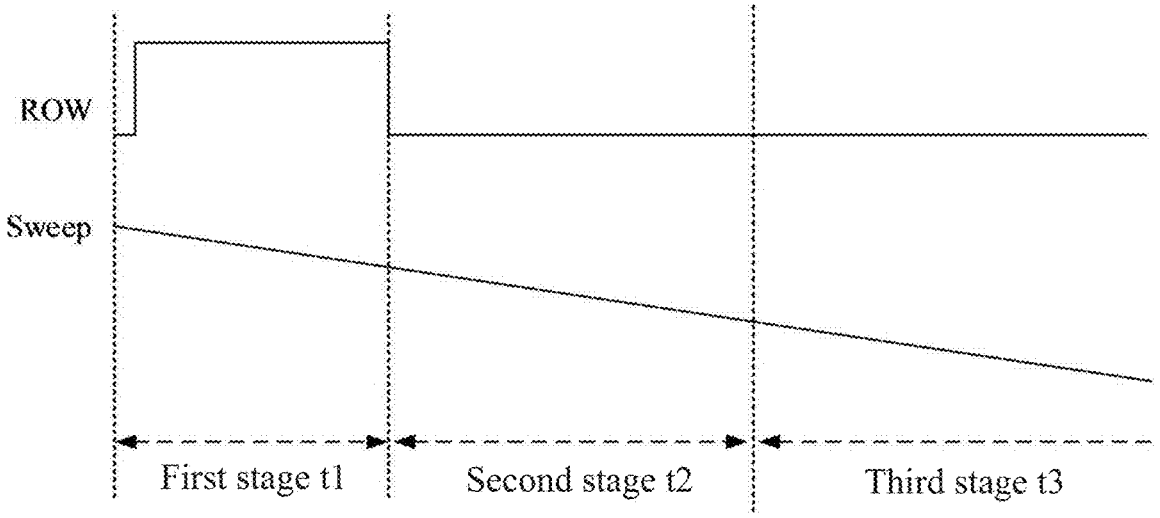
FIG. 8 is a control timing diagram of a driving signal of a pixel driver circuit shown in FIG. 7.

FIG. 7 is a flowchart of another driving method for a display panel according to an embodiment of the present disclosure. FIG. 8 is a control timing diagram of a driving signal of a pixel driver circuit shown in FIG. 7. Referring to FIG. 6 to FIG. 8, in the driving method, step S1 includes a step described below. At the first stage t1, the first transistor 111 writes the data signal to the first node 101.

The scan signal ROW input to the gate 1113 of the first transistor 111 is a high level signal at the first stage t1. At this time, the first transistor 111 is turned on, and the first electrode 1111 of the first transistor 111 receives the data signal, so that the data signal is written to the first node 101.

Step S2 includes the steps described below. At the second stage t2, the second transistor 112 and the third transistor 113 adjust the potential of the second node 102, such that the potential of the second node 102 is greater than the reference signal Vref, the comparison module 15 outputs the first control signal, and the light emission control module 16 is turned off.

A process of adjusting the potential of the second node 102 by the second transistor 112 and the third transistor 113 is essentially a process of changing the resistances of the second transistor 112 and the third transistor 113, and the resistances of the second transistor 112 and the third transistor 113 can be adjusted by changing gate-source voltage values of the second transistor 112 and the third transistor 113. As can be seen from FIG. 6, the potential of the first node 101 and signals of the first level signal end and the potential pulse signal end determine the resistances of the second transistor 112 and the third transistor 113, that is, the potential of the second node 102. Further, the first level signal VGH as a fixed level signal is described as an example, and the potential of the second node 102 depends on the potential adjustment pulse signal Sweep. As shown in FIG. 8, the waveform of the potential adjustment pulse signal Sweep acquired by the second potential adjustment module 14 may be selected as a sawtooth wave, Apparently, when the potential adjustment pulse signal Sweep is a sawtooth wave with a downward trend, the potential of the second node 102 also shows a downward trend following the potential adjustment pulse signal Sweep, By reasonably setting the data signal input and stored by the first node 101, it can be satisfied that the potential of the second node 102 is greater than the reference signal Vref at the second stage t2, so that the comparison module 15 outputs the high level signal, that is, the first control signal, to control the fourth transistor 114 to turn off.

Figure 9:
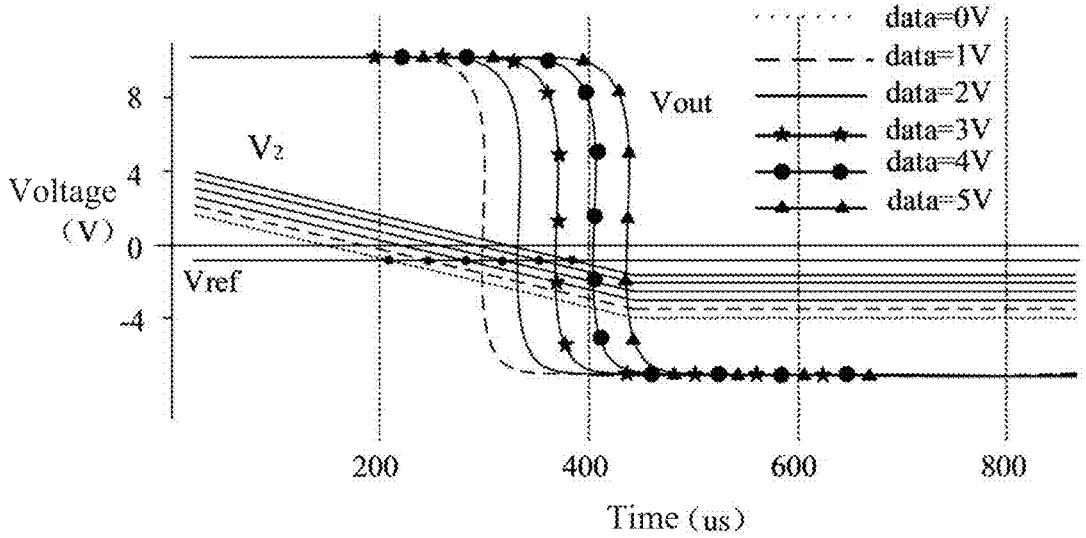
FIG. 9 is a graph illustrating the relationship between the potential of the second node and the output signal of the comparison module under different data signals according to an embodiment of the present disclosure.

For the pixel driver circuit illustrated in FIG. 6, the potential $V_2$ of the second node under different data signals and the output signal Vout of the comparison module are experimentally investigated in the embodiment of the present disclosure. The data signal data adopts 0V, 1V, 2V, 3V, 4V and 5V, respectively. FIG. 9 is a graph illustrating a relationship between a potential of a second node and an output signal of a comparison module under different data signals according to an embodiment of the present disclosure. Referring to FIG. 6, FIG. 8 and FIG. 9, firstly, the data signal data as 0V is described as an example. The potential $V_2$ of the second node 102 is controlled by the resistance of the second transistor 112, and the potential $V_2$ of the second node 102 keeps a consistent variation trend with the potential adjustment pulse signal Sweep and presents the sawtooth waveform. At the first stage t1 and the second stage t2, the potential $V_2$ of the second node 102 is at a high potential and continues to fall, but is still greater titan the reference signal Vref, Apparently, at the first stage t1 and the second stage t2, when a voltage value of the positive phase input end 1311 of the comparator 131 is greater than a voltage value of the inverting input end 1312, the comparator 131 outputs a high level, and an output signal Vout, after passing through two inverters 141, remains at a high level. For the fourth transistor 114 of the P-type, at this time, the gate is input a high level, the transistor is turned off and the light emitting element is in the off state.

Step S3 includes the steps described below. At the third stage t3, the second transistor 112 and the third transistor 113 adjust the potential of the second node 102, such that the potential of the second node 102 is less than the reference signal Vref, the comparison module 15 outputs the second control signal, and the light emission control module 16 outputs the driving signal.

Referring to FIG. 7 and FIG. 8, still taking the data signal data as 0V for example, at the third stage t3, the potential adjustment pulse signal Sweep continues to fall, so that the potential $V_2$ of the second node 102 can continue to fall through the third transistor 113, and the potential $V_2$ of the second node 102 is lower than the reference signal Vref. At this time, the voltage value of the positive phase input end 1311 of the comparator 131 is greater than the voltage value of the inverting input end 1312, the comparator 131 outputs a low level, and the output signal Vout, after passing through the two inverters 141, remains at the low level. For the fourth transistor 114 of the P-type, at this time, the gate is input the low level, the transistor is turned on, and the driving current is supplied to the light emitting element from the output end to drive the light emitting element to emit light.

Still referring to FIG. 9, when the potential $V_2$ of the second node is greater than the reference signal $V_{ref}$, the pixel driver circuit is at the first stage t1 and the second stage t2; and when the potential of the second node is less than the reference signal Vref, the pixel driver circuit is at the third stage t3. Furthermore, when the potential $V_2$ of the second node falls equal to the reference signal Vref, the sawtooth waveform of the potential $V_2$ of the second node intersects the reference signal Vref, and an abscissa of an intersecting point is a time junction point of the second stage t2 and the third stage t3.

When the data signal data is 0V to 5V respectively, the potential $V_2$ of the second node is compared with the output signal Vout of the comparison module, and it can be seen that the potential $V_2$ of the second node 102 mainly depends on the potential adjustment pulse signal Sweep, but is also affected by the data signal data at the same time, By changing the value of the data signal data, the potential of the second node 102 will change accordingly, which in turn causes a level jump time node of the output signal Vout of the comparison module to be different. Specifically, when the data signal data changes from 0V to 5V, the potential $V_2$ of the second node rises accordingly, and as illustrated in FIG. 9, the sawtooth waveform of the potential $V_2$ of the second node moves up as a whole. In the case where the reference signal Vref remains unchanged, the intersection point of the potential $V_2$ of the second node and the reference signal Vref moves in an abscissa direction, and a corresponding time junction point of the second stage t2 and the third stage t3 moves backward, That is, when the value of the data signal data is appropriately increased, the time length of the third stage t3 can be correspondingly reduced, the light emitting duration of the light emitting element is reduced, and the luminance of the light emitting element is reduced. On this basis, those skilled in the art can adjust the time junction point of the second stage t2 and the third stage t3 by reasonably setting the reference signal and the value of the data signal, so as to control a proportion of the light emitting duration of the light emitting element and further control the luminance of the light emitting element. When the time length of the third stage t3 is 0, the light emitting element remains in the off state in the whole image display cycle, so the pixel unit is at a lowest gray scale. When the pixel driver circuit directly enters the third stage t3 after passing through the first stage t1, the time length of the second stage t2 is 0, the time length of the third stage t3 is the largest, and the luminance of the light emitting element is the brightest in the whole image display cycle, which corresponds to a highest gray scale of the pixel unit.

Figure 10:
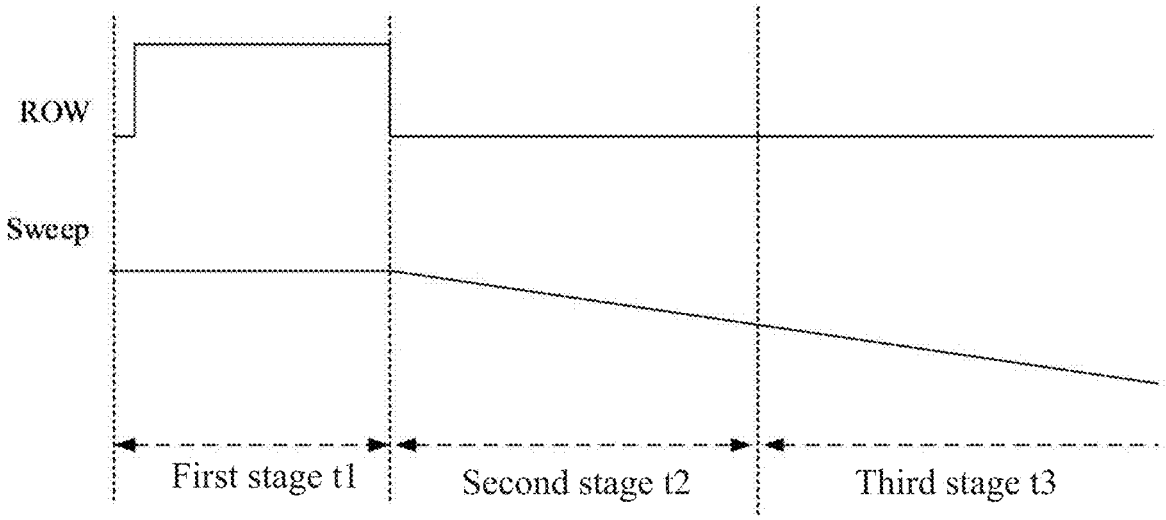
FIG. 10 is another control timing diagram of a driving signal of a pixel driver circuit according to an embodiment of the present disclosure.

FIG. 10 is another control timing diagram of a driving signal of a pixel driver circuit according to an embodiment of the present disclosure. Referring to FIG. 6 and FIG. 10, in the pixel driver circuit in the embodiment of the present disclosure, optionally, the potential adjustment pulse signal Sweep acquired by the second potential adjustment module 14 is a constant voltage signal at the first stage t1. This stage is mainly used to write the data signal into the first node 101, so the first potential adjustment module 13 and the second potential adjustment module 14 do not need to be adjusted.

Figure 11:
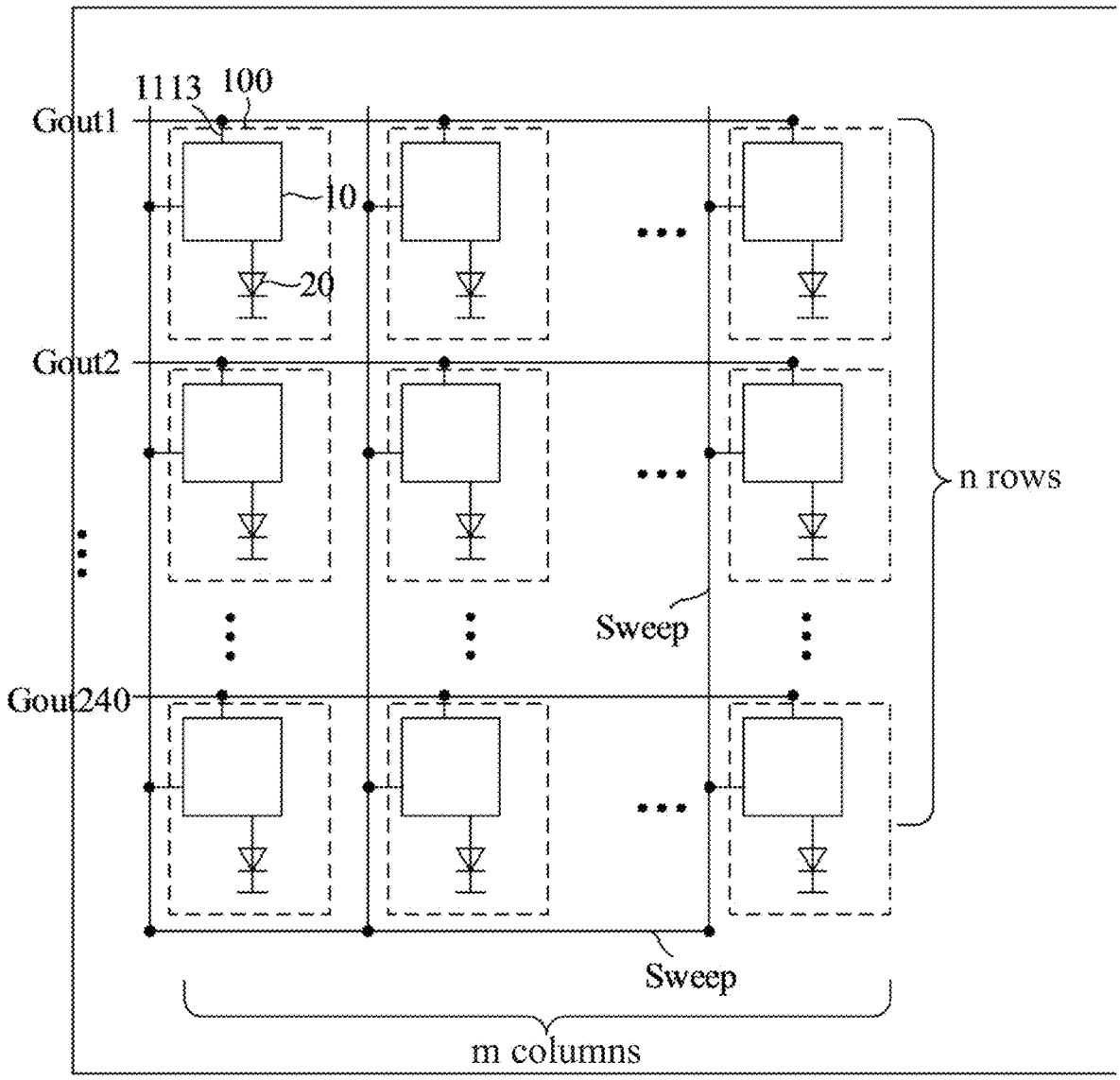
FIG. 11 is a schematic diagram of another display panel according to an embodiment of the present disclosure.

On the basis of the pixel driver circuit and the display panel provided in the above-mentioned embodiment, potential adjustment pulse signal ends Sweep in each pixel driver circuit 10 may be optionally electrically connected. At this time, a same potential adjustment pulse signal Sweep is provided at the potential adjustment pulse signal end Sweep of each pixel driver circuit 10, and a suitable data signal is only input into to the input end of the data write module to control the luminance of each light emitting element. FIG. 11 is a schematic diagram of another display panel according to an embodiment of the present disclosure. Referring to FIG. 6 and FIG. 11, specifically, the display panel may be configured to include a plurality of potential pulse signal lines Sweep in parallel; the plurality of pixel driver circuits 10 in the display panel are arranged in the plurality of rows and columns; potential pulse signal ends Sweep of a same row of pixel driver circuits 10 are connected to a same potential pulse signal line Sweep; and each potential pulse signal line Sweep is electrically connected. Of course, those skilled in the art may further configure the potential pulse signal ends Sweep of pixel driver circuits 10 of a same column to be connected to a same potential pulse signal line Sweep, and each potential pulse signal line Sweep to be electrically connected, which is not limited herein.

Referring to FIG. 6 and FIG. 11, exemplarily, the display panel may include n rows and m columns of pixel units 100, where gates 1113 of first transistors 111 of each row of pixel driver circuits 10 are electrically connected to a same scan signal line Gout. For example, when n is 240, the display panel includes 240 scan signal lines Gout. Meanwhile, first electrodes 1111 of first transistors 111 in each column of the pixel driver circuits 10 are electrically connected to the same data signal line (not shown in the figure). The pixel driver circuit 10 in each pixel unit 100 provides the scan signal through the scan signal line Gout at the first stage and when the scan signal jumps to the high level, the first transistor 111 is turned on. The data signal on the data signal line is written into and stored in the first node 101 in the pixel driver circuit 10 through the first transistor 111.

Figure 12:
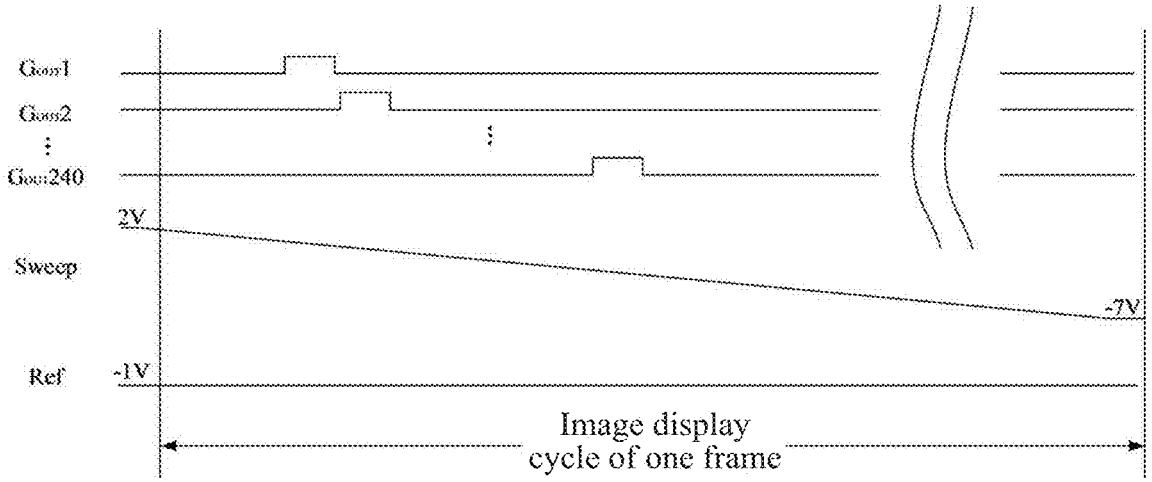
FIG. 12 is another control timing diagram of a driving signal in a driving method for a display panel according to an embodiment of the present disclosure.

On this basis, an embodiment of the present disclosure further provides a driving method for a display panel. FIG. 12 is another control timing diagram of a driving signal in a driving method for a display panel according to an embodiment of the present disclosure. Referring to FIG. 6, FIG. 11 and FIG. 12, each row of scan signal lines provides the scan signal Gout. When the level of the scan signal Gout jumps to the high level, the first transistor 111 is turned on, and the row of pixel driver circuits 10 writes the data signal into the first node 101 in advance. Therefore, when the scan signal Gout is the high level signal, the pixel driver circuit of the corresponding row is at the first stage t1 of data writing. The plurality of pixel driver circuits in the display panel provided by the embodiment of the present disclosure are arranged in the plurality of rows and columns. In the driving method provided by the above-mentioned embodiment, the pixel driver circuit 10 of each row of pixel units 100 may execute the third stage t3 after the first stage t1 of each row pixel driver circuit 10 is completed in the image display cycle of one frame. That is, each row pixel driver circuit 10 in the display panel may write the data signal into the first node 101 in advance through the first stage t1. After all the pixel driver circuits 10 of the whole display panel complete the first stage t1, the second node 102 of each pixel driver circuit 10 can be adjusted by using the written data signal and the continuously falling potential adjustment pulse signal Sweep, such that the potential $V_2$ of the second node at this time is lower than the voltage of the reference signal Vref, thereby driving each pixel driver circuit 10 to execute the third stage t3. Of course, between the first stage t1 and the third stage t3, the potential $V_2$ of the second node is still maintained at a voltage greater than the reference signal Vref, so that the pixel driver circuit 10 at this time is substantially at the second stage t2, the comparison module outputs the first control signal, and the light emitting element is in the off state.

It is to be noted that, still referring to FIG. 12, the first stage t1 of each pixel driver circuit 10 in the whole display panel is a stage of data signal writing, which is essentially a stage in which the scan signal on the corresponding scan signal line Gout is in a high level state, and at this time, the first transistor 10 in the pixel driver circuit 10 is turned on by the control of the high level scan signal, while the data signal lines in the column provide the data signal, so that the data signal can be written into the first node 101 of the pixel driver circuit 10.

Figure 13:
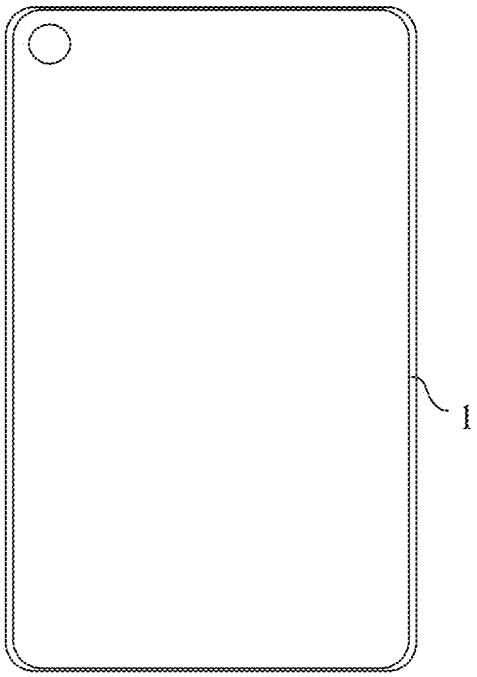
FIG. 13 is a schematic diagram of a display device according to an embodiment of the present disclosure.

An embodiment of the present disclosure further provides a display device. FIG. 13 is a schematic diagram of a display device according to an embodiment of the present disclosure, Referring to FIG. 13, the display device includes any one of the display panels 1 provided by the embodiments of the present disclosure. The liquid crystal display device may specifically be a mobile phone, a computer, a smart wearable apparatus and so on.

The foregoing merely depict some illustrative embodiments according to the present disclosure and the technical principles used herein. Those skilled in the art will appreciate that the present disclosure will not be limited to the specific embodiments described herein, and they will also be able to make various apparent modifications, adaptations, combinations and substitutions without departing from the scope of the present disclosure. Therefore, while the present disclosure has been described in detail through the foregoing embodiments, the present disclosure will not be limited to the above-described embodiments and may further include many other equivalent embodiments without departing from the concept of the present disclosure. The scope of the present disclosure is thus only determined in and by the appended

What is claimed is:

1. A pixel driver circuit, comprising a data write module, a storage module, a first potential adjustment module, a second potential adjustment module, a comparison module, and a light emission control module;

wherein the data write module is electrically connected to the first potential adjustment module at a first node; the storage module is electrically connected between the first node and a first level signal end; the first potential adjustment module is electrically connected between the first level signal end and a second node; the first potential adjustment module is electrically connected to the second potential adjustment module at the second node; the second potential adjustment module comprises a potential pulse signal end, and the second node is electrically connected to a first input end of the comparison module; a second input end of the comparison module is in control of a reference signal; and an output end of the comparison module is electrically connected to a control end of the light emission control module;

the data write module is configured to write a data signal into the first node at a first stage; the first potential adjustment module and the second potential adjustment module are configured to adjust a potential of the second node at a second stage, causing the comparison module to output a first control signal to the control end of the light emission control module based on the potential of the second node and the reference signal; and the light emission control module is configured to control an output end of the light emission control module to be turned off according to the first control signal; and the first potential adjustment module and the second potential adjustment module are configured to adjust the potential of the second node at a third stage, causing the comparison module to output a second control signal to the control end of the light emission control module based on the potential of the second node and the reference signal; and the light emission control module is configured to output a driving signal through the output end of the light emission control module according to the second control signal.

2. The pixel driver circuit of claim 1, wherein the data write module comprises a first transistor; the storage module comprises a first capacitor; and the first potential adjustment module comprises a second transistor; wherein a first electrode of the first transistor is configured for obtaining the data signal; a second electrode of the first transistor is electrically connected to the first node; a gate of the first transistor is in control of a scan signal; a first plate of the first capacitor is electrically connected to the first node; a second plate of the first capacitor is electrically connected to the first level signal end; a gate of the second transistor is electrically connected to the first node; a first electrode of the second transistor is electrically connected to the first level signal end; and a second electrode of the second transistor is electrically connected to the second node.

3. The pixel driver circuit of claim 1, wherein the second potential adjustment module comprises a third transistor, wherein a gate of the third transistor is electrically connected to the first level signal end, a first electrode of the third transistor is configured for obtaining a potential adjustment pulse signal, and a second electrode of the third transistor is electrically connected to the second node.

4. The pixel driver circuit of claim 1, wherein the comparison module comprises a comparator; a positive phase input end of the comparator is the first input end of the comparison module; an inverting input end of the comparator is the second input end of the comparison module; a first power supply end of the comparator is electrically connected to the first level signal end, and a second power supply end of the comparator is electrically connected to a second level signal end.

5. The pixel driver circuit of claim 4, wherein the comparison module further comprises an inverter unit, wherein an output end of the comparator is electrically connected to an input end of the inverter unit; an output end of the inverter unit is the output end of the comparison module; and the inverter unit comprises at least one inverter connected in sequence.

6. The pixel driver circuit of claim 1, wherein the light emission control module comprises a fourth transistor, wherein a gate of the fourth transistor is the control end of the light emission control module, a first electrode of the fourth transistor is electrically connected to a first power supply signal end, and a second electrode of the fourth transistor is the output end of the light emission control module.

7. A driving method for a display panel, the display panel comprising the pixel driver circuit of claim 1, and the driving method comprising:

S1, at a first stage, writing, by the data write module, a data signal into the first node;

S2, at a second stage, adjusting, by the first potential adjustment module and the second potential adjustment module, the potential of the second node, causing the comparison module to output a first control signal to the control end of the light emission control module based on the potential of the second node and the reference signal; wherein the light emission control module is in control of the first control signal, and the output end of the light emission control module is turned off;

S3, at a third stage, adjusting, by the first potential adjustment module and the second potential adjustment module, the potential of the second node, causing the comparison module to output a second control signal to the control end of the light emission control module based on the potential of the second node and the reference signal; wherein the light emission control module is in control of the second control signal, and the output end of the light emission control module outputs a driving signal.

8. The driving method of claim 7, wherein the data write module comprises a first transistor; the storage module comprises a first capacitor; the first potential adjustment module comprises a second transistor; a first electrode of the first transistor is configured for obtaining the data signal; a second electrode of the first transistor is electrically connected to the first node; a gate of the first transistor is in control of a scan signal; a first plate of the first capacitor is electrically connected to the first node; a second plate of the first capacitor is electrically connected to a first level signal end; a gate of the second transistor is electrically connected to the first node; a first electrode of the second transistor is electrically connected to the first level signal end; and a second electrode of the second transistor is electrically connected to the second node;

wherein the second potential adjustment module comprises a third transistor, wherein a gate of the third transistor is electrically connected to the first level signal end, a first electrode of the third transistor is configured for obtaining a potential adjustment pulse signal, and a second electrode of the third transistor is electrically connected to the second node;

wherein operation S1 comprises:

at the first stage, writing, by the first transistor, the data signal into the first node;

wherein operation S2 comprises:

at the second stage, adjusting, by the second transistor and the third transistor, the potential of the second node causing the potential of the second node to be greater than the reference signal, and outputting, by the comparison module, the first control signal causing the light emission control module to be turned off; and wherein operation S3 comprises:

at the third stage, adjusting, by the second transistor and the third transistor, the potential of the second node, causing the potential of the second node to be less than or equal to the reference signal, and outputting, by the comparison module, the second control signal causing the light emission control module to output the driving signal.

9. The driving method of claim 7, wherein a potential adjustment pulse signal obtained by the second potential adjustment module has a waveform of a sawtooth wave.

10. The driving method of claim 7, wherein a potential adjustment pulse signal obtained by the second potential adjustment module is a constant voltage signal at the first stage.

11. The driving method of claim 7, wherein a plurality of pixel driver circuits in the display panel are arranged in a plurality of rows and columns; and in the image display cycle of one frame, after the first stage of each row of the plurality of pixel driver circuits is completed, the pixel driver circuits of each row of pixel units execute the third stage.

12. A display panel, comprising a plurality of pixel units arranged in a matrix, wherein each of the plurality of pixel units comprises a light emitting element and the pixel driver circuit of claim 1; and an output end of a light emission control module of the pixel driver circuit is electrically connected to an anode of the light emitting element.

13. The display panel of claim 12, wherein respective potential pulse signal ends of the pixel driver circuits are electrically connected to each other.

14. The display panel of claim 13, comprising a plurality of potential pulse signal lines arranged in parallel; wherein the plurality of pixel driver circuits in the display panel are arranged in a plurality of rows and columns; and wherein the potential pulse signal ends of the pixel driver circuits in a same row or in a same column are connected to the same potential pulse signal line; and wherein the plurality of potential pulse signal lines are electrically connected to each other.

15. The display panel of claim 12, wherein the data write module comprises a first transistor; the storage module comprises a first capacitor; and the first potential adjustment module comprises a second transistor; wherein a first electrode of the first transistor is configured for obtaining the data signal; a second electrode of the first transistor is electrically connected to the first node; a gate of the first transistor is in control of a scan signal; a first plate of the first capacitor is electrically connected to the first node; a second plate of the first capacitor is electrically connected to the first level signal end; a gate of the second transistor is electrically connected to the first node; a first electrode of the second transistor is electrically connected to the first level signal end; and a second electrode of the second transistor is electrically connected to the second node.

16. The display panel of claim 12, wherein the second potential adjustment module comprises a third transistor, wherein a gate of the third transistor is electrically connected to the first level signal end, a first electrode of the third transistor is configured for obtaining a potential adjustment pulse signal, and a second electrode of the third transistor is electrically connected to the second node.

17. The display panel of claim 12, wherein the comparison module comprises a comparator; a positive phase input end of the comparator is the first input end of the comparison module; an inverting input end of the comparator is the second input end of the comparison module; a first power supply end of the comparator is electrically connected to the first level signal end, and a second power supply end of the comparator is electrically connected to a second level signal end.

18. The display panel of claim 17, wherein the comparison module farther comprises an inverter unit, wherein an output end of the comparator is electrically connected to an input end of the inverter unit; an output end of the inverter unit is the output end of the comparison module; and the inverter unit comprises at least one inverter connected in sequence.

19. The display panel of claim 12, wherein the light emission control module comprises a fourth transistor, wherein a gate of the fourth transistor is the control end of the light emission control module, a first electrode of the fourth transistor is electrically connected to a first power supply signal end, and a second electrode of the fourth transistor is the output end of the light emission control module.

20. A display device, comprising the display panel of claim 12.

* * * * *